US008425189B2

(12) United States Patent
Jaeger et al.

(10) Patent No.: US 8,425,189 B2
(45) Date of Patent: Apr. 23, 2013

(54) ROTOR MOUNTING

(75) Inventors: Christoph Jaeger, Gerolsheim (DE); Rolf Witzel, Ebersburg (DE); Heinrich Braun, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 0 days.

(21) Appl. No.: 12/726,863

(22) Filed: Mar. 18, 2010

(65) Prior Publication Data

US 2010/0189567 A1 Jul. 29, 2010

Related U.S. Application Data

(63) Continuation of application No. PCT/EP2008/007385, filed on Sep. 10, 2008.

(30) Foreign Application Priority Data

Sep. 18, 2007 (DE) ..... 10 2007 044 646

(51) Int. Cl.
*F04D 29/054* (2006.01)

(52) U.S. Cl.
USPC ..... 415/216.1; 416/204 A; 416/244 A

(58) Field of Classification Search ..... 415/216.1; 416/204 A, 204 R, 244 A, 244 B, 244 R, 416/245 A, 245 R
See application file for complete search history.

(56) References Cited

U.S. PATENT DOCUMENTS

| | | | | |
|---|---|---|---|---|
| 2,010,525 | A | 8/1935 | McHugh | |
| 3,717,045 | A * | 2/1973 | Burenga | 74/15.6 |
| 3,904,301 | A * | 9/1975 | Schroeder | 403/259 |
| 4,257,744 | A * | 3/1981 | Watson | 416/244 R |
| 4,810,918 | A * | 3/1989 | Kachuk | 310/90 |
| 6,012,901 | A | 1/2000 | Baettig et al. | |
| 6,017,184 | A | 1/2000 | Aguilar et al. | |
| 2002/0006332 | A1 * | 1/2002 | Haugen et al. | 415/216.1 |

FOREIGN PATENT DOCUMENTS

DE 30 00 344 A1 7/1980

(Continued)

OTHER PUBLICATIONS

International Search Report dated Jan. 8, 2009 including partial translation and PCT/ISA/237 (Twelve (12) pages).

(Continued)

*Primary Examiner* — Edward Look
*Assistant Examiner* — Liam McDowell
(74) *Attorney, Agent, or Firm* — Crowell & Moring LLP

(57) ABSTRACT

A rotor mounting on one end of a shaft, particularly a shaft end of a centrifugal pump unit, in which an adjusting surface and at least one contact surface are constructed on the shaft end, and in which a rotor hub is provided at least on the end facing the shaft with a central bore having an internal thread. The rotor hub is attached to the shaft end by a screw connection. The shaft has a central bore (16) having an internal thread (17) at least on the end facing the rotor hub (12); a threaded pin (18) constructed as a separate component is disposed in both central bores (13, 16) in a connecting, torque-transmitting and force-transmitting manner, and the rotor is aligned on the shaft solely by the adjusting surfaces (20) and contact surfaces (21).

10 Claims, 3 Drawing Sheets

FOREIGN PATENT DOCUMENTS

| | | | |
|---|---|---|---|
| DE | 198 02 115 | A1 | 8/1998 |
| DE | 698 25 088 | T2 | 7/2005 |
| EP | 0 903 465 | A1 | 3/1999 |
| FR | 2288888 | A2 | 5/1976 |
| GB | 11 56 678 | A | 7/1969 |
| GB | 2 039 615 | A | 8/1980 |

OTHER PUBLICATIONS

German Search Report dated Sep. 23, 2008 (Three (3) pages).
International Preliminary Report on Patentability, English translation. Seven (7) pages, Apr. 2010.

* cited by examiner

PRIOR ART

ROTOR MOUNTING

CROSS REFERENCE TO RELATED APPLICATIONS

This application is a continuation of international patent application no. PCT/EP2008/007385, filed Sep. 10, 2008, designating the United States of America, and published in German on Mar. 26, 2009 as WO 2009/036915, the entire disclosure of which is incorporated herein by reference. Priority is claimed based on Federal Republic of Germany patent application no. DE 10 2007 044 646.4, filed Sep. 18, 2007.

BACKGROUND OF THE INVENTION

The invention relates to a rotor mounting at one end of a shaft, in particular a shaft end of a centrifugal pump assembly, a fitting surface and at least one bearing surface or a conical surface being formed at the shaft end, a rotor hub being provided, at least at its end facing the shaft, with a central bore with an internal thread and being fastened to the shaft end by a threaded screw connection.

It is known to screw rotors of centrifugal pump assemblies consisting of a pump and motor to a motor shaft end constructed with a threaded stub. In this case, the shaft end has one or more cylindrical fitting surfaces and one or more axial bearing surfaces. When a rotor is being mounted onto such a shaft end, the rotor hub is screwed onto the threaded stub. As a result of manufacturing tolerances, such a solution has the disadvantage that, when the rotor hub is being mounted onto the shaft end, the thread causes a tilting of the rotor hub with respect to the shaft. The consequences are inadequate radial run-out properties and/or axial run-out properties of the parts to be joined together. In addition, there is the risk of a seizure of the thread and bearing surfaces, thus making a possible demounting of the arrangement difficult.

SUMMARY OF THE INVENTION

It is therefore an object of the invention to provide a rotor mounting which can be produced at less expense.

Another object of the invention is to provide a rotor mounting which allows easy mounting and demounting of the rotor.

A further object of the invention is to provide a rotor mounting which has good radial and axial run-out properties.

These and other objects are achieved in accordance with the present invention by the rotor mounting as described and claimed hereinafter.

In accordance with the present invention, the shaft has, at least at its end facing the rotor hub, a central bore with an internal thread, a headless pin constructed as a separate component is arranged connectingly and in a torque- and force-transmitting manner in the two central bores, and the rotor hub is oriented on the shaft via the fitting and bearing surfaces. This leads to very good radial and axial run-out properties. As a result of the headless pin arranged centrally in the hub end and shaft end and due to the tolerances in the thread flights, when the connection is being tightened the decoupled threads can no longer tilt with respect to the shaft a rotor which is to be attached. The headless pin acts as a kind of joint, as a result of which the fitting and bearing surfaces alone ensure radial and axial run-out accuracy. This also makes it possible to operate such a rotor with very high rotation speeds, which is especially advantageous for variable-speed centrifugal pump assemblies.

At the same time, a seizure of the thread or bearing surfaces is effectively prevented, this also making it easy to demount the arrangement. Owing to the additional degree of freedom of the thread afforded by the separate headless pin, it is possible for the force-transmitting connecting element in the form of the headless pin to adapt to the conditions of the fitting and bearing surfaces. Force transmission or torque transmission is thus afforded solely by the headless pin and the radial run-out properties of the shaft are afforded solely by the centering via the fitting surface and the axial run-out property is determined by the bearing surfaces.

In a further embodiment of the invention, a cylindrical centering surface and an axial bearing surface are formed at the shaft end. A rotor hub bears, in the mounted state, against these surfaces and is thereby oriented on the shaft.

In this case, it is advantageous if the cylindrical centering surface has an axial length equal to or larger than its diameter. A sufficiently large fitting surface is thereby provided. During a mounting of the centrifugal pump assembly, the rotor can be pre-centered on the shaft end via the cylindrical centering surface.

In another refinement of the invention, the central bore of the hub and/or the central bore of the shaft end are/is formed as a blind hole. The thread is consequently protected against the penetration of conveyed liquid.

Alternatively, a rotor mounting with a conical surface arranged at one end of a shaft is provided, the shaft having, at least at its end facing the rotor hub, a central bore with an internal thread, a headless pin constructed as a separate component being arranged connectingly and in a torque- and force-transmitting manner in the two central bores, and the rotor hub being oriented on the shaft solely via the conical surface which forms both a fitting and a bearing surface. Such a rotor mounting affords production advantages due to the smaller number of surfaces to be machined.

In addition, the headless pin may be provided with a tool-holding fixture at at least one end. As a result, this headless pin can, for example, be brought into its mounting position within the central bore in a simple way.

BRIEF DESCRIPTION OF THE DRAWINGS

The invention will be described in further detail hereinafter with reference to illustrative embodiments shown in the accompanying drawing figures, in which.

DETAILED DESCRIPTION OF PREFERRED EMBODIMENTS

Figure 1:
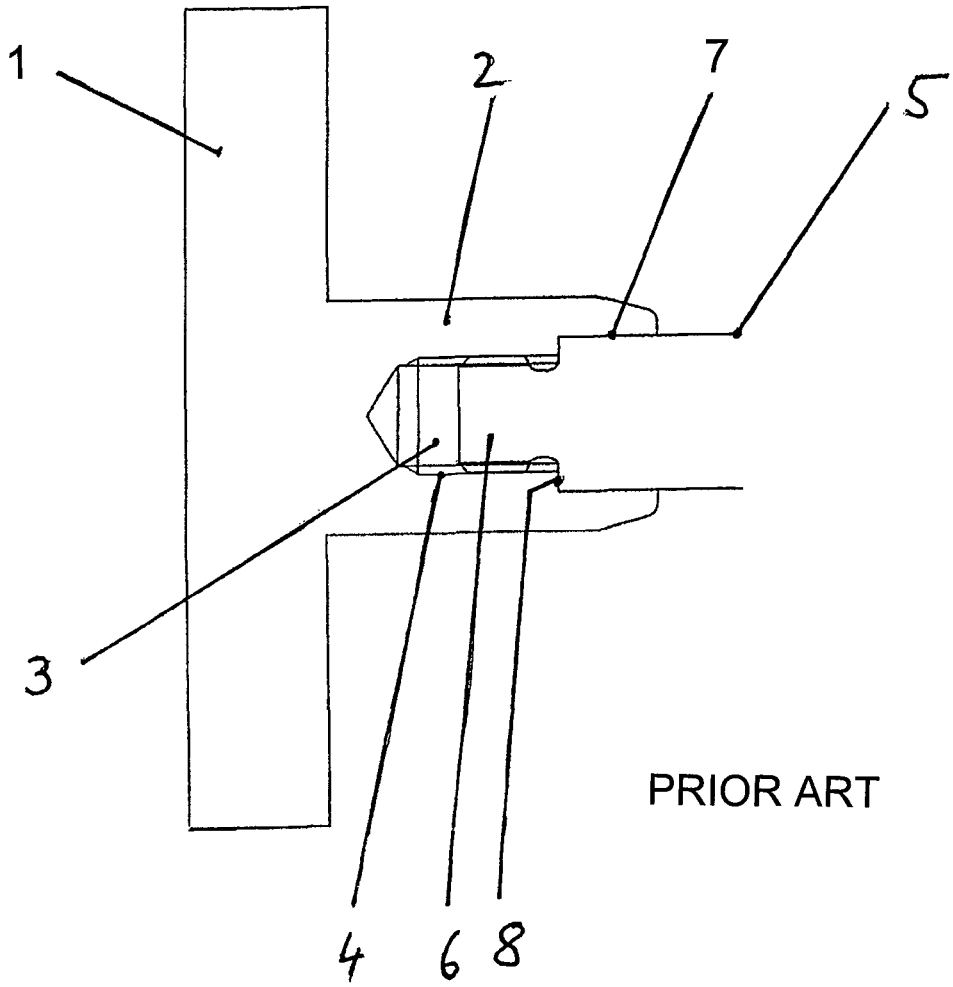
FIG. 1 shows a rotor mounting according to the prior art.

FIG. 1 shows a detail of a centrifugal pump assembly and of a rotor mounting according to the prior art. For the sake of clarity, only the parts relevant to the rotor mounting are illustrated.

A rotor 1 with a rotor hub 2 and with a central bore 3, formed here as a blind hole with an internal thread 4 is shown. A shaft end 5, for example of a shaft of a block engine, has a threaded stub 6 with external thread. The shaft end 5 has a cylindrical fitting surface 7 and a radial bearing surface 8. The rotor 1 is screwed with its rotor hub 2 onto the threaded stub 6 of the shaft end 5. Due to manufacturing tolerances, this solution has the disadvantage that, when the rotor hub 2 is being mounted onto the shaft end 5, the thread 4 causes a tilting of the rotor hub 2 with respect to the shaft. The consequences are inadequate radial run-out properties and/or axial run-out properties of the shaft and rotor 1. In addition, there is the risk of a seizure of the threads and at the bearing surface 8, as a result of which a possible demounting of the arrangement is made difficult.

Figure 2:
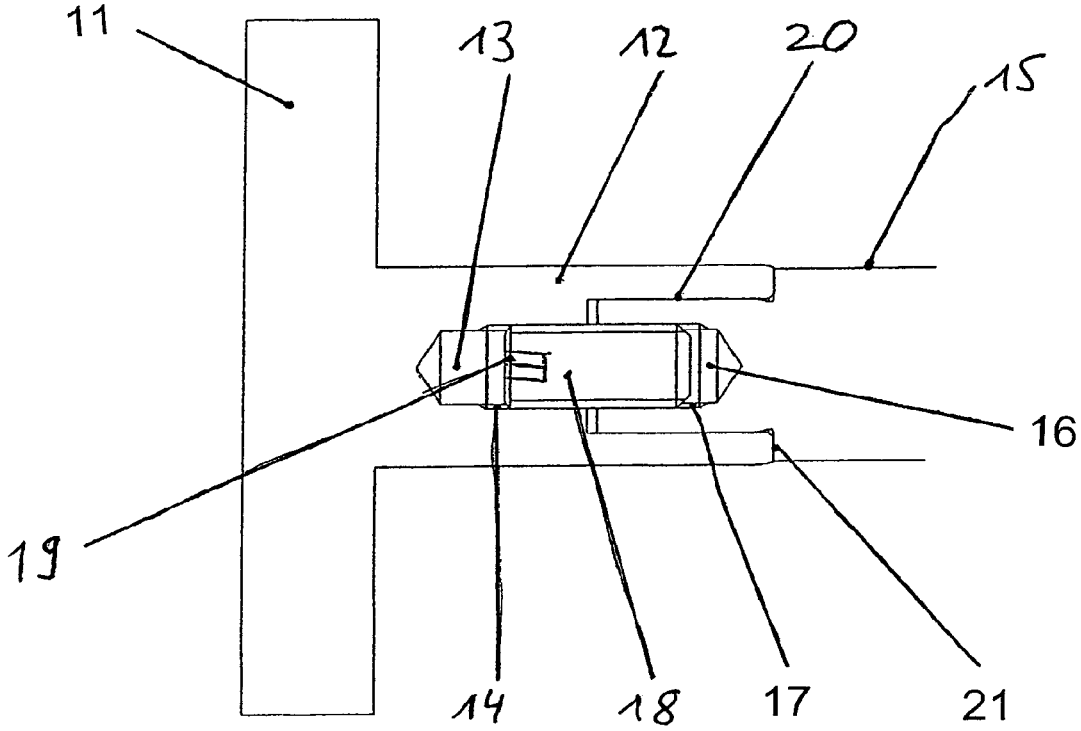
FIG. 2 shows a first decoupled rotor mounting according to the present invention.

FIG. 2 shows a rotor mounting according to the invention. A rotor 11 has a rotor hub 12 with a central bore 13 and with an internal thread 14. Furthermore, a shaft end 15 is illustrated. The shaft end 15 has a hollow end section 16 with an internal thread 17. A headless pin 18 serves for mounting the rotor 11 on the shaft end 15 and is screwed, during mounting, into the central bore 16. This headless pin can be screwed into the central bore 16 using conventional tools due to the tool-holding fixture 19 which may be constructed, for example, as a hexagonal socket, a slot or a wrench-engaging surface. During the mounting of the rotor hub 12, a cylindrical fitting surface 20 serves for pre-centering. This fitting or centering surface 20 is configured in such a way that, during mounting, a good pre-centering and, during the operation of an assembly, good radial run-out properties are achieved. The headless pin 18 can move loosely, and the fitting or orientation of the rotor takes place solely via the fitting surface 20 or bearing surface 21 provided for this purpose.

Due to the design of the headless pin 18 as a separate component, which is arranged connectingly in the two central bores 13, 16, decoupling within the rotor mounting is achieved. In this case, the headless pin 18 fulfills the function of torque or force transmission. The orientation of the rotor hub takes place solely via the fitting surface 20 and the bearing surface 21. In this case, the fitting surface 20 ensures the radial run-out properties and the bearing surface 21 ensures the axial run-out properties of the arrangement. This leads to very good radial and axial run-out properties. As a result of the headless pin 18 arranged centrally in the rotor hub end and shaft end, and due to the tolerances in the thread flights, when the connection is being tightened the decoupled threads can no longer tilt with respect to the shaft of the rotor 11 which is to be mounted. This also makes it possible to operate such a rotor 11 at very high rotational speeds, which is especially advantageous for variable-speed centrifugal pump assemblies.

Figure 3:
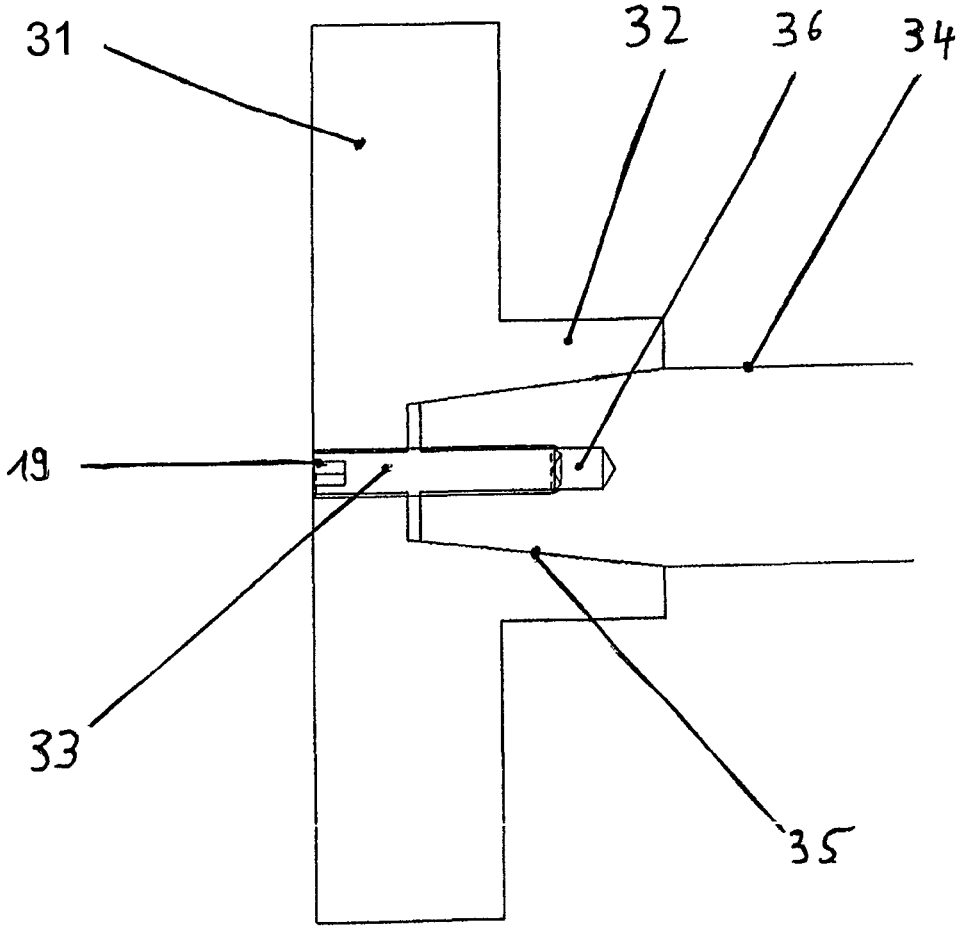
FIG. 3 shows another decoupled rotor mounting according to the present invention.

FIG. 3 shows another rotor mounting according to the invention with a rotor 31, a rotor hub 32 and a central bore 33 drilled through the rotor. A shaft end 34 likewise has a central bore 36. In this rotor mounting, the shaft end 34 is provided with a conical surface 35. The conical surface 35 simultaneously forms both a bearing surface and a fitting surface and affords the additional advantage of simple production.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A rotor mounting at one end of a shaft, said mounting comprising a radial fitting surface and at least one axial bearing surface formed on the one end of the shaft, and a rotor hub provided at least at an end thereof facing the shaft, with a central bore of the rotor having an internal thread; said rotor hub being fastened to the one end of the shaft by a threaded screw connection, wherein at least the one end of the shaft facing the rotor hub has a central bore of the shaft with an internal thread;

the shaft and the rotor hub are connected in a torque- and force-transmitting matter by a headless pin constructed as a separate component and arranged in the central bore of the rotor and the central bore of the shaft, and the rotor hub is oriented on the shaft solely by said fitting and bearing surfaces.

2. The rotor mounting as claimed in claim 1, wherein the radial fitting surface is a cylindrical centering surface and the axial bearing surface and the cylindrical centering surface are formed on the one end of the shaft.

3. The rotor mounting as claimed in claim 2, wherein the cylindrical centering surface has an axial length equal to or larger than a diameter of the cylindrical centering surface.

4. The rotor mounting as claimed in claim 3, wherein during a mounting of the rotor on the shaft, the rotor is pre-centered on the shaft end by the cylindrical centering surface.

5. The rotor mounting as claimed in claim 1, wherein at least one of the central bore of the rotor hub and the central bore of the shaft previously presented is constructed as a blind hole.

6. The rotor mounting as claimed in claim 1, wherein at least one end of the headless pin is provided with a tool-holding fixture.

7. The rotor mounting as claimed in claim 1, wherein the one end of the shaft is a shaft end of a centrifugal pump assembly.

8. A rotor mounting at one end of a shaft, said mounting comprising a bearing surface formed as a circular conical surface on the one end of the shaft, and a rotor hub provided at least at an end facing said shaft with a central bore of the rotor having an internal thread; said rotor hub being fastened to the one end of the shaft by a threaded screw connection, wherein at least the end of the shaft facing the rotor hub is provided with a central bore of the shaft having an internal thread;

the one end of the shaft and the rotor hub are connected in a torque- and force-transmitting manner by a headless pin constructed as a separate component and arranged in the central bore of the rotor and the central bore of the shaft, and the rotor hub is oriented on the shaft solely by the circular conical surface which forms both a fitting and a bearing surface.

9. The rotor mounting as claimed in claim 8, wherein at least one end of the headless pin is provided with a tool-holding fixture.

10. The rotor mounting as claimed in claim 8, wherein the one end of the shaft is a shaft end of a centrifugal pump assembly.

* * * * *